US008096689B2

(12) United States Patent
Engl et al.

(10) Patent No.: US 8,096,689 B2
(45) Date of Patent: Jan. 17, 2012

(54) MOTOR-VEHICLE HEADLIGHT

(75) Inventors: Moritz Engl, Regensburg (DE); Stefan Grötsch, Bad Abbach (DE); Markus Hofmann, Bad Abbach (DE); Rainer Huber, Pentling (DE); Kurt Jürgen Lang, Regen (DE); Mario Wanninger, Regensburg (DE)

(73) Assignee: Osram Opto Semiconductors GmbH, Regensburg (DE)

( * ) Notice: Subject to any disclaimer, the term of this patent is extended or adjusted under 35 U.S.C. 154(b) by 65 days.

(21) Appl. No.: 11/924,209

(22) Filed: Oct. 25, 2007

(65) Prior Publication Data

US 2008/0094851 A1 Apr. 24, 2008

Related U.S. Application Data

(63) Continuation of application No. PCT/DE2006/000631, filed on Apr. 10, 2006.

(30) Foreign Application Priority Data

Apr. 29, 2005 (DE) ..... 10 2005 020 085

(51) Int. Cl.
*F21V 17/02* (2006.01)

(52) U.S. Cl. ..... 362/514; 362/543

(58) Field of Classification Search ..... 362/543–545, 362/249.02, 249.06, 249.16, 514, 517, 282, 362/318

See application file for complete search history.

(56) References Cited

U.S. PATENT DOCUMENTS

| | | | | |
|---|---|---|---|---|
| 3,316,442 | A | 4/1967 | Zuse | |
| 4,729,072 | A * | 3/1988 | Oroza | 362/517 |
| 4,794,501 | A * | 12/1988 | Bartenbach | 362/298 |
| 4,872,745 | A * | 10/1989 | Fujisawa et al. | 359/268 |
| 4,985,816 | A | 1/1991 | Seko et al. | |
| 5,672,001 | A | 9/1997 | Bertling et al. | |
| 5,954,416 | A * | 9/1999 | Peterson | 362/35 |
| 6,059,435 | A | 5/2000 | Hamm et al. | |
| 6,601,982 | B1 | 8/2003 | Begemann et al. | |
| 6,883,947 | B1 | 4/2005 | Sarabia | |
| 2001/0024171 | A1 * | 9/2001 | Nishimura | 342/70 |
| 2004/0240217 | A1 * | 12/2004 | Rice | 362/465 |
| 2005/0128764 | A1 * | 6/2005 | Enders | 362/509 |
| 2007/0097238 | A1 * | 5/2007 | Li | 348/268 |

FOREIGN PATENT DOCUMENTS

| | | |
|---|---|---|
| DE | 1 167 773 | 4/1964 |
| DE | 1 190 413 | 4/1965 |
| DE | 44 29 496 | 6/1995 |
| DE | 44 36 620 | 4/1996 |
| DE | 197 56 437 | 6/1999 |

(Continued)

OTHER PUBLICATIONS

Preliminary Notice of Rejection for IPO Ref.: (97)IPI(5)05074—No. 0972028833001 (Application No. 095115153) dated Jun. 5, 2008.

(Continued)

*Primary Examiner* — Julie Shallenberger
(74) *Attorney, Agent, or Firm* — Fish & Richardson P.C.

(57) ABSTRACT

A motor-vehicle headlight is specified, having at least one light-emitting diode, and an apparatus for controllable manipulation of the beam path of the electromagnetic radiation emitted from the light-emitting diode. The described motor-vehicle headlight is distinguished inter alia by a particularly variable emission characteristic.

16 Claims, 4 Drawing Sheets

FOREIGN PATENT DOCUMENTS

| | | |
|---|---|---|
| DE | 100 05 795 | 8/2001 |
| DE | 102 33 719 | 2/2004 |
| EP | 1 195 552 | 4/2002 |
| JP | 63-119101 | 5/1988 |
| JP | 1-244934 | 9/1989 |
| JP | 03-008202 | 1/1991 |
| JP | 03-040303 | 2/1991 |
| JP | 07-245003 | 9/1995 |
| JP | 2001-042237 | 2/2001 |
| JP | 2002-042516 | 2/2002 |
| JP | 2002-343108 | 11/2002 |
| JP | 2004-207235 | 7/2004 |
| JP | 2004-241142 | 8/2004 |
| JP | 2004-327188 | 11/2004 |
| TW | M242401 | 9/2004 |
| WO | WO 01/59360 | 8/2001 |

OTHER PUBLICATIONS

Japan Patent Office, "Translation of the Notification of Reasons for Refusal (type I office action)" Application No. 2008-508067, mailed on Mar. 16, 2011 (8 pages).

Moyse, Ellen, "English Translation of the International Preliminary Report on Patentability", The International Bureau of WIPO, International Application No. PCT/DE2006/000631, mailed on Oct. 30, 2007 (7 pages).

Cosnard, D., English Translation of the Written Opinion of the International Searching Authority, International Searching Authority, International Application No. PCT/DE2006/000631, mailed on Aug. 21, 2006 (6 pages).

Cosnard, D., "English Translation of the International Search Report", International Searching Authority, International Application No. PCT/DE2006/000631, mailed on Aug. 21, 2006 (3 pages).

* cited by examiner

MOTOR-VEHICLE HEADLIGHT

CROSS REFERENCE TO RELATED APPLICATIONS

This application is a continuation of and claims the benefit of priority of International Application No. PCT/DE2006/000631, filed Apr. 10, 2006, which claims priority to German Patent Application No. 10 2005 020 085.0, filed Apr. 29, 2005, the contents of which are incorporated herein by reference.

FIELD OF INVENTION

This disclosure relates to a motor-vehicle headlight.

BACKGROUND OF THE INVENTION

The document U.S. Pat. No. 6,601,982 B2 describes a prior art motor-vehicle headlight.

SUMMARY OF THE INVENTION

A motor-vehicle headlight is disclosed.

Preferably the motor-vehicle headlight achieves one or more of the following objects: long-life; versatility; and a particularly variable emission characteristic.

According to at least one embodiment of the motor-vehicle headlight, the motor-vehicle headlight contains a light-emitting diode. The motor-vehicle headlight preferably contains a large number of light-emitting diodes. Each light-emitting diode contains at least one light-emitting diode chip. The light-emitting diode preferably contains a plurality of light-emitting diode chips. The light-emitting diode chips in one light-emitting diode are preferably followed by light-emitting diode optics in the main emission direction of the light-emitting diode chips.

The light-emitting diodes in the motor-vehicle headlight are preferably suitable for the production of white light. For this purpose, a light-emitting diode in a motor-vehicle headlight may comprise a plurality of light-emitting diode chips whose radiation is mixed to form white light. Furthermore, it is also possible for the light-emitting diode chips in the light-emitting diode to be followed by a luminescence conversion material. The electromagnetic radiation emitted from the light-emitting diode chips is then mixed with the frequency converted component of the radiation to form white light.

Furthermore, it is also possible for at least one of the light-emitting diodes in the headlight to be suitable for production of light of a specific colour—for example yellow light. Furthermore, it is also possible for at least one of the light-emitting diodes in the headlight to be suitable for production of infrared electromagnetic radiation.

According to at least one embodiment of the motor-vehicle headlight, the motor-vehicle headlight contains an apparatus for controllable manipulation of the beam path of the electromagnetic radiation emitted from the light-emitting diode. The apparatus is preferably suitable for controllable manipulation of the beam paths of a plurality of light-emitting diodes associated with the apparatus.

The expression manipulation of the beam path of the electromagnetic radiation emitted from a light-emitting diode could be understood, for example, as meaning a disturbance, an influence or a change in the beam path. Manipulation of the beam path may, for example, comprise a direction change, a change in the intensity, collimation, scattering, focusing, filtering or frequency conversion of the emitted radiation. For this purpose, the apparatus is arranged in the beam path of the light-emitting diode.

Controllable means that the manipulation is carried out in a manner which can be predetermined externally. This means that, for example, a human user or a computation unit can use the apparatus to specifically manipulate the beam path of the light-emitting diode. The beam path is then manipulated in a defined, predeterminable manner. Controllable also means that the apparatus can be used to switch between at least two states. It is preferably possible to switch between a large number of different states. This means that if, for example, the manipulation of the beam path comprises a direction change of the emitted radiation, then it is possible to use the apparatus to choose between at least two directions to which the beam path is deflected. It is preferably possible to choose between a large number of radiation directions. The direction change can particularly preferably be varied continuously, at least in a specific angular range.

According to at least one embodiment of the motor-vehicle headlight, the motor-vehicle headlight contains a light-emitting diode and an apparatus for controllable manipulation of the beam path of the electromagnetic radiation emitted from the light-emitting diode. The electromagnetic radiation emitted from the light-emitting diode forms at least a part of the electromagnetic radiation emitted from the headlight. This means that the emission characteristic of the light-emitting diode forms the emission characteristic of the headlight, or a part of the emission characteristic of the headlight, by the emission characteristics of a plurality of light-emitting diodes being superimposed to form the emission characteristic of the headlight. It is thus possible to deliberately vary the emission characteristic of the headlight by manipulation of the beam path of the at least one light-emitting diode. In this case, the expression emission characteristic means the spatial intensity or brightness distribution of the emitted light. For example, the headlight may have a conical emission characteristic. This means that the areas of identical intensity or brightness in the emitted light form a cone in space. Furthermore, a large number of other shapes of the emission characteristic of the headlight are possible.

In this case, inter alia, the headlight makes use of the idea that it is possible to switch between different emission characteristics of the headlight by means of the apparatus, by manipulation of the beam path of the electromagnetic radiation emitted from the light-emitting diode. For example, the apparatus can be used to switch between emission characteristics for various traffic and lighting situations. The apparatus is, for example, suitable for defined selection of different emission characteristics for urban driving, driving on motorways and/or different weather conditions such as rain and fog. Furthermore, it is also possible for the apparatus to allow readjustment of the direction of the emission characteristic of the headlight when turning.

According to at least one embodiment of the motor-vehicle headlight, the apparatus is suitable for reflection of the electromagnetic radiation emitted from the light-emitting diode. This means the apparatus is at least partially located in the beam path of the light-emitting diode and is suitable for reflection of at least a part of the electromagnetic radiation emitted from the light-emitting diode. By way of example, the apparatus may in this case be suitable for defined adjustment of the direction of the electromagnetic radiation emitted from the light-emitting diode. It is also possible for the apparatus to be suitable for collimation or widening of the radiation emitted from the light-emitting diode, by means of reflections.

Furthermore, it is possible for the apparatus to be suitable for diffuse reflection of at least a part of the emitted radiation.

According to at least one embodiment of the motor-vehicle headlight, the apparatus is suitable for refraction of at least a part of the electromagnetic radiation emitted from the light-emitting diode. Refraction, makes it possible, for example, to carry out a direction change, collimation or widening of the radiation emitted from the light-emitting diode. The apparatus can preferably be used to adjust the refraction in a defined manner. This means, for example, that the refractive index can be adjusted in a defined manner. It is also possible to use the apparatus to adjust the position of an optically refractive element in the beam path of the light-emitting diode. By way of example, this means that a specific proportion of the radiation emitted from the light-emitting diode can be refracted in a defined manner, while another portion of the radiation remains unrefracted.

According to at least one embodiment of the headlight, the apparatus is suitable for scattering at least a part of the electromagnetic radiation emitted from the light-emitting diode. This means that the electromagnetic radiation emitted from the light-emitting diode is widened and mixed by means of the apparatus. The degree of scatter, that is to say the widening, and the degree of mixing are preferably in this case adjustable.

According to at least one embodiment, the apparatus is suitable for absorption of the radiation emitted from the light-emitting diode. This means that at least a part of the electromagnetic radiation emitted from the light-emitting diode can be absorbed in a defined manner by means of the apparatus. For example, this can be achieved by a shutter being movable in the beam path of the light-emitting diode.

According to at least one embodiment, the apparatus is suitable for filtering at least a part of the radiation emitted from the light-emitting diode. By way of example, this can be achieved by moving a filter element in the beam path of the light-emitting diode. This means, for example, that the apparatus is suitable for reducing the intensity of the radiation emitted from the light-emitting diode. The emission characteristic of the headlight can thus be matched to the external lighting conditions. It is also possible for the apparatus to be suitable for filtering radiation at specific wavelengths, so that the headlight emits light of a specific colour. This makes it possible, for example, to select yellow light, which is particularly highly suitable for driving in fog.

According to at least embodiment of the motor-vehicle headlight, the apparatus is suitable for carrying out two or more of the stated functions. For example, the apparatus may thus be suitable for simultaneous reflection and scattering of the electromagnetic radiation emitted from the light-emitting diode. By way of example, a diffusely reflective mirror can be used for this purpose. It is also possible, for example, for the apparatus to be suitable for refraction and filtering of electromagnetic radiation. By way of example, a lens which contains colour pigments can be used for this purpose. Furthermore, a large number of further combinations of the mentioned functions are feasible in one apparatus. It is also possible to use the apparatus to switch between different functions of those mentioned.

According to at least one embodiment of the motor-vehicle headlight, the apparatus comprises a deflection mirror. The deflection mirror is suitable for defined variation of the direction of at least a part of the electromagnetic radiation emitted from the light-emitting diode. For example, the deflection mirror can be moved relative to the beam path of the light-emitting diode in order to deflect the electromagnetic radiation emitted from the light-emitting diode in a defined manner in a specific direction. For this purpose, the deflection mirror can preferably be moved relative to the beam path of the light-emitting diode. This allows the radiation emitted from the light-emitting diode to be readjusted to the match the curvature of the curve when turning.

It is also possible to use the movement of the deflection mirror to vary the direction of the radiation emitted from the light-emitting diode relative, for example, to the roadway on which the motor vehicle is moving. For example, the direction of the radiation can be deflected downwards—towards the roadway—or upwards—away from the roadway. This allows the direction of the emitted light to be matched to the inclination of the motor vehicle.

According to at least one embodiment of the motor-vehicle headlight, the deflection mirror is mounted such that it can rotate. For example, the deflection mirror may be mounted such that it can rotate about a plurality of axes. In this case, for example, the deflection mirror can be rotated not only in order to compensate for the inclination of the vehicle but also to readjust the beam direction of the light-emitting diode when turning.

According to at least one embodiment of the motor-vehicle headlight, the deflection mirror comprises a polygonal wheel mirror. This means that the deflection mirror comprises a plurality of mirror surfaces which are arranged to form a polygon wheel. For this purpose, the deflection mirror has a cylindrical shape, by way of example, with the outer surface of the cylinder being formed by a plurality of planar or curved mirror surfaces.

The polygonal wheel mirror can preferably be moved relative to the beam path of the light-emitting diode, for example by being mounted such that it can rotate. The direction of the reflected radiation can be adjusted by rotation of the polygonal wheel mirror about its longitudinal axis.

According to at least one embodiment of the motor-vehicle headlight, the polygonal wheel mirror is mounted such that it can rotate in such a way that different mirror surfaces of the polygonal wheel mirror are illuminated by rotation of the polygonal wheel mirror. This means that it is possible for the polygonal wheel mirror to be rotated through an angle such that a different mirror surface—for example an adjacent mirror surface—is illuminated by the light-emitting diode. This means that it is possible to switch between the illumination of different mirror surfaces by rotation of the polygonal wheel mirror.

According to at least one embodiment, the polygonal wheel mirror has at least two mirror surfaces with different optical characteristics to one another. For example, one of the mirror surfaces may be shaped in such a manner that it is suitable for collimation of the radiation emitted from the light-emitting diode. For this purpose, for example, the mirror surface may have a concave curvature. This makes it possible to produce concentrated radiation as is used as part of main-beam switching of the headlight.

A further mirror surface of the polygonal wheel mirror may be suitable for diffuse reflection of the light from the light-emitting diode. This makes it possible, for example, to produce a broad beam cone from the arrangement as may be used, for example, when the headlight is switched for urban driving. It is thus possible to switch between different emission characteristics of the arrangement comprising the light-emitting diode and polygonal wheel mirror, and thus of the headlight, by illumination of the different mirror surfaces of the polygonal wheel mirror.

According to at least one embodiment, the apparatus for controllable manipulation of the beam path of the electromagnetic radiation emitted from the light-emitting diode comprises a wedge-shaped pane. This means that the pane has, for example, a triangular cross section.

The wedge-shaped pane is formed from a material through which at least some of the electromagnetic radiation emitted from the light-emitting diode can pass. When passing through the pane, at least a part of the electromagnetic radiation emitted from the light-emitting diode is refracted. This allows the direction of the radiation to be changed in a defined manner. The wedge-shaped pane is preferably in the form of a solid body, which means that the wedge-shaped pane preferably has no cavities. The wedge-shaped pane is then formed from a homogeneous material. By way of example, the wedge-shaped pane may in this case be composed of a glass.

According to at least one embodiment of the motor-vehicle headlight, the position of the pane can be moved in the beam path of the light-emitting diode. This means that the pane can preferably be moved in directions longitudinally and/or transversely with respect to the beam path. This makes it possible to adjust any direction change of the electromagnetic radiation on the basis of the refraction of the pane, in a defined manner. By way of example, the position of the wedge-shaped pane in the beam path can be varied in order to vary the optical position or the optical distance of the light-emitting diode relative to a projection lens. Furthermore, the direction change of the radiation is governed by the beam angle of the wedge and by the refractive index of the material from which the wedge-shaped pane is formed.

Furthermore, it is also possible for the wedge-shaped pane to have at least parts which are designed to scatter or to filter light. Widening of the beam cone, darkening or a colour change of the emitted electromagnetic radiation can then be achieved by movement of a part of the wedge into the beam path of the light-emitting diode, in order to change the direction. The degree of scatter or darkening can in this case be adjusted by the thickness of the pane in the radiation path, and thus by means of the position of the pane in the beam path of the light-emitting diode.

According to at least one embodiment of the motor-vehicle headlight, the apparatus for controllable manipulation of the beam path of a light-emitting diode comprises an element whose optical characteristics can be adjusted by application of an electrical voltage. For this purpose, the element is arranged in the beam path of the light-emitting diode in such a way that it can optically influence at least a part of the electromagnetic radiation emitted from the light-emitting diode. The optical characteristics of the element may, for example, comprise the refractive index, absorption characteristics, filter characteristics or light-scattering characteristics of the element.

According to at least one embodiment, the element contains an electrochromic material. This means that the colour filter characteristics of the element can be adjusted as a function of a voltage which is applied to the element. The element can then, for example, be switched such that it transmits only more light of a specific colour. This makes it possible, for example, to produce yellow light from a headlight, which is particularly highly suitable for driving in fog.

According to at least one embodiment of the motor-vehicle headlight, the element is made of self-darkening glass. This means that the radiation absorption characteristics of the element can be adjusted as a function of a voltage which is applied to the element. For example, the intensity and/or the brightness of the light which is emitted from the light-emitting diode can be reduced in this way. An element such as this is suitable, for example, for daylight driving or for dipped-beam selection.

According to at least one embodiment of the motor-vehicle headlight, the element comprises a switchable diffusor pane. This means that the light scattering characteristics of the element can be adjusted as a function of a voltage which is applied to the element.

The degree of scatter produced by the diffusor pane is in this case preferably dependent on the voltage applied to the diffusor pane. A relatively high degree of scatter of the electromagnetic radiation emitted from the light-emitting diode can thus be used for a relatively broad emission characteristic, in order to illuminate the area directly in front of the motor vehicle.

An emission characteristic such as this is suitable, for example, for driving slowly in an urban region. Reduced scatter is suitable, for example, for driving on country roads.

According to at least one embodiment of the motor-vehicle headlight, the refractive index of the element can be adjusted as a function of the voltage which is applied to the element. By way of example, the element may for this purpose comprise a high-voltage membrane. It is thus possible, for example, to switch between different emission characteristics by variation of the voltage which is applied to the membrane.

According to at least one embodiment of the motor-vehicle headlight, the position of the light-emitting diode relative to an optical element is variable. The optical element may, for example, comprise a lens. By way of example, the direction of the radiation can be changed by changing the position of the light-emitting diode relative to the optical element. The direction of the beam cone can then, for example, be matched to the curvature of a curve by changing the position of the light-emitting diode relative to the optical element.

According to at least one embodiment of the motor-vehicle headlight, the headlight has at least two light-emitting diodes. The light-emitting diodes are preferably arranged in the headlight such that they are suitable for illumination of different spatial angle areas.

This means that, for example, the main emission direction of a first group of light-emitting diodes—comprising at least one light-emitting diode—points in the straight-ahead direction away from the motor vehicle, while the main emission directions of further light-emitting diodes include an angle with the main emission direction of this group. These further light-emitting diodes can then, for example, be switched on when the motor vehicle is turning, so that the direction of the light emitted from the headlight in this way follows the profile of the curve. For this purpose, the light-emitting diodes may, for example, also be arranged on a flexible circuit board of appropriate shape.

The headlight in this case preferably has a switching apparatus which is suitable for switching light-emitting diodes as a function of the direction of travel of the motor vehicle. This means that the switching apparatus may, for example, be coupled directly to a steering apparatus for the motor vehicle. Any steering movement then results in appropriately aligned light-emitting diodes then being switched on. Light-emitting diodes which emit light in the straight-ahead direction can be dimmed or switched off by the switching apparatus when turning. When the steering apparatus is moved back to the position for driving straight ahead, the light-emitting diodes for turning light are switched off again by means of the switching apparatus.

The motor-vehicle headlight described here will be explained in more detail in the following text using exemplary embodiments and with reference to the associated figures.

DESCRIPTION OF THE DRAWINGS

Identical components or components having the same effect are each provided with the same reference symbols in the exemplary embodiments and figures. The illustrated elements should not be regarded as being to scale, and in fact individual elements may be illustrated in an exaggerated enlarged form, in order to assist understanding.

DETAILED DESCRIPTION OF THE PREFERRED EMBODIMENTS

Figure 1:
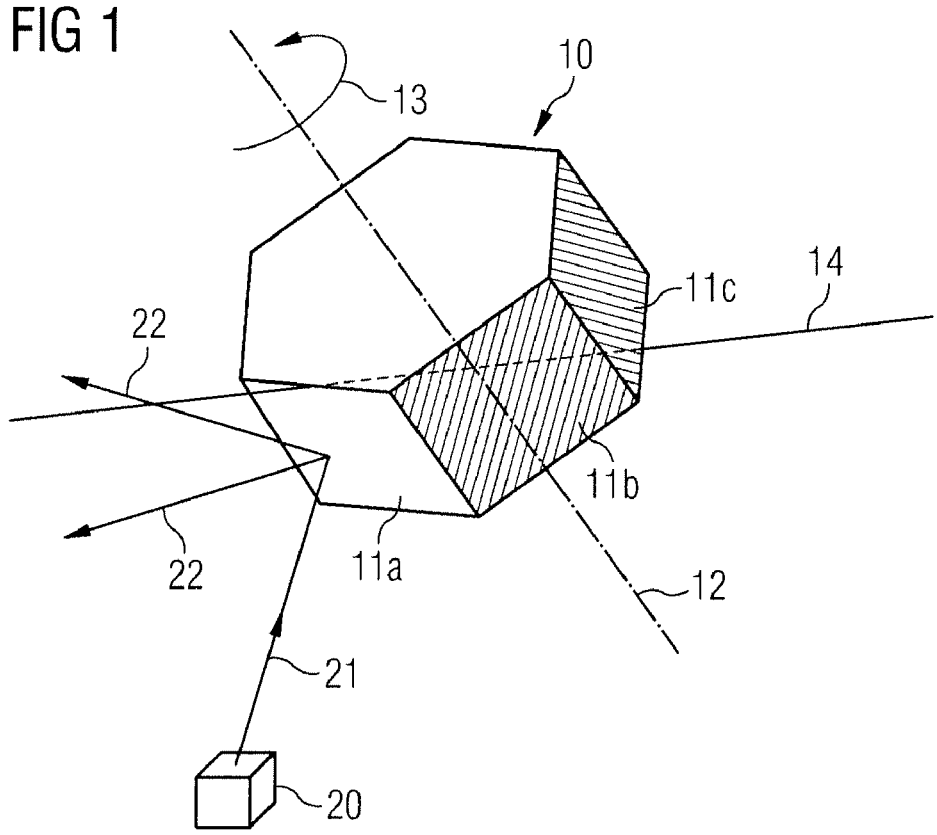
FIG. 1 shows a schematic perspective sketch of the light-emitting diode and of the apparatus for controllable manipulation of the beam path of the light-emitting diode, according to a first exemplary embodiment.

FIG. 1 shows a schematic perspective sketch of a light-emitting diode 20 with an apparatus for controllable manipulation of the beam path 21, 22 of the electromagnetic radiation emitted from the light-emitting diode.

The apparatus is a polygonal wheel mirror 10. The polygonal wheel mirror 10 has mirror surfaces 11*a*, 11*b* and 11*c*. Furthermore, the polygonal wheel mirror 10 may have further mirror surfaces. The maximum number of mirror surfaces can in fact by determined by the number of edges of the polygon.

The optical characteristics of the mirror surfaces 11*a*, 11*b* and 11*c* of the polygonal wheel mirror 10 may differ from one another. For example, the mirror surfaces may be suitable for focusing or scattering of the radiation 21 arriving at them from the light-emitting diode 20. The optical characteristics of the mirror surfaces 11*a*, 11*b*, 11*c* determine the emission characteristic of the radiation 22 reflected by the mirror surfaces. This means that the mirror surfaces 11*a*, 11*b*, 11*c* can determine characteristics such as shape, intensity distribution, colour, direction and beam angle of the reflected radiation 22.

By way of example, one of the mirror surfaces 11*a*, 11*b*, 11*c* may comprise a sandpaper mirror. A sandpaper mirror such as this has a roughened, reflective surface. Incident radiation 21 is reflected diffusely on the sandpaper mirror. This makes it possible, to produce an emission characteristic from the headlight which is particularly suitable for urban driving. This means that the area in front of the car is illuminated as broadly as possible.

Further mirror surfaces 11*a*, 11*b*, 11*c* may, for example, be suitable for dipped-beam, main-beam or motorway headlight switching operations.

The polygonal wheel mirror 10 is preferably mounted such that it can rotate about its longitudinal axis 12. In this case, the polygonal wheel mirror—as indicated by arrows 13—can be rotated through an angle such that a different mirror surface 11*b*, 11*c* is illuminated, rather than a first mirror surface 11*a*. This makes it possible to switch between different emission characteristics by rotation of the polygonal wheel mirror 10 about the rotation axis 12.

If the polygonal wheel mirror 10 is rotated through small angles, in such a way that the angle at which the incident beam 21 strikes a mirror surface 11*a* changes, the emission direction of the radiation can be adjusted by means of the rotation process, with the emission characteristic otherwise remaining essentially unchanged. Such rotations of the polygonal wheel mirror 10 are suitable, for example, for readjustment of the beam cone of a headlight or parts of the beam cone of a headlight to match the curvature of a curve when turning.

Overall, the polygonal wheel mirror which is mounted such that it can rotate thus represents an apparatus by means of which it is possible to select various illumination states and emission directions.

Furthermore, it may also be possible to mount the polygonal wheel mirror 10 such that it can rotate about an axis 14 which, for example, runs transversely with respect to the longitudinal axis 12. This makes it possible, for example to point the direction of the reflected radiation 22 towards the roadway or away from the roadway. It is thus possible to compensate for the inclination of a motor vehicle.

Figure 2:
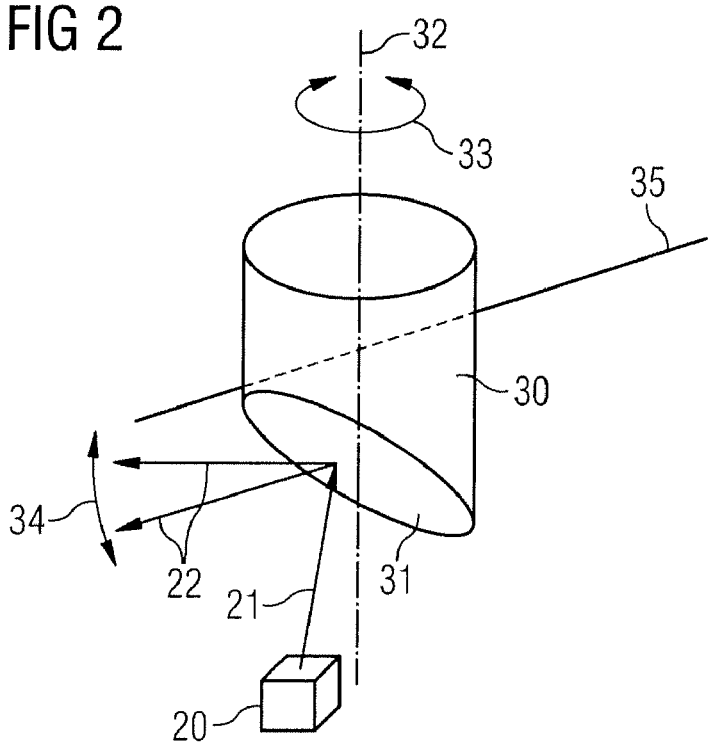
FIG. 2 shows a schematic perspective sketch of the light-emitting diode and of the apparatus for controllable manipulation of the beam path of the light-emitting diode according to a second exemplary embodiment.

FIG. 2 shows a second exemplary embodiment of an apparatus for controllable manipulation of the radiation 21, 22 emitted from a light-emitting diode 20. The illustrated apparatus is a cylindrical mirror 30 which has a mirror surface 31 that is formed by a cylinder section. The mirror surface is suitable for reflection of electromagnetic radiation 21 emitted from the light-emitting diode. The optical characteristics of the mirror surface 31 may be chosen in such a manner that the reflected radiation has a desired emission characteristic.

The cylindrical mirror 30 is mounted such that it can rotate about its longitudinal axis 32. The direction of the reflected radiation 22 can be adjusted by rotation about the longitudinal axis 32—indicated by the arrow 33. For example, the emission direction of the reflected radiation 22 can be readjusted to match the curvature of a curve when turning. However, depending on the arrangement of the cylindrical mirror and of the light-emitting diode relative to one another, it is also possible to compensate for inclination of the motor vehicle, by rotation of the cylindrical mirror.

Furthermore and in addition it is possible to mount the cylindrical mirror such that it can rotate about a lateral axis 35 which, for example, runs at right angles to the longitudinal axis 32.

Figure 3A:
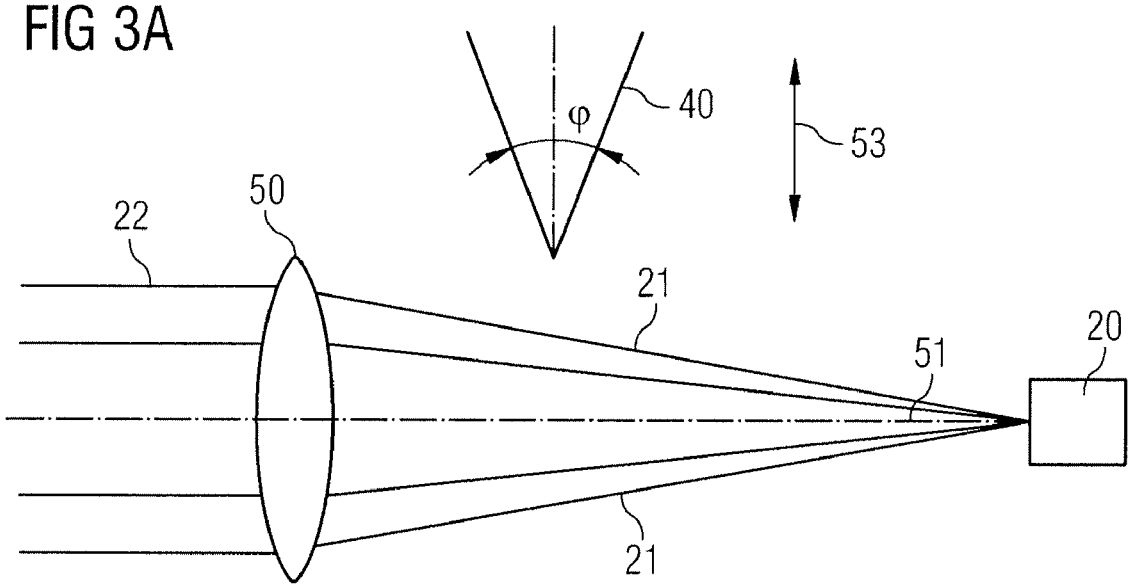
FIGS. 3A, 3B and 3C show a schematic perspective sketch of the light-emitting diode and of the apparatus for controllable manipulation of the beam path of the light-emitting diode according to a third exemplary embodiment.
Figure 3B:
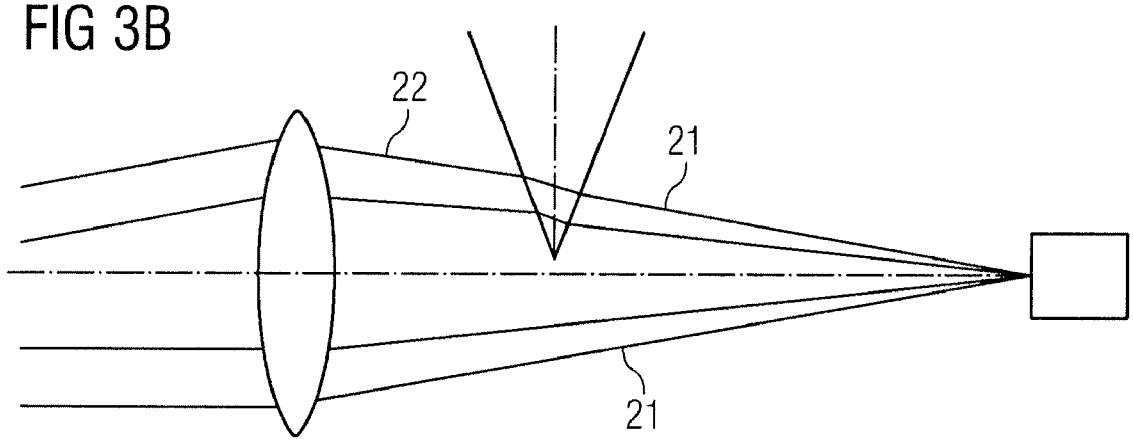
Figure 3C:
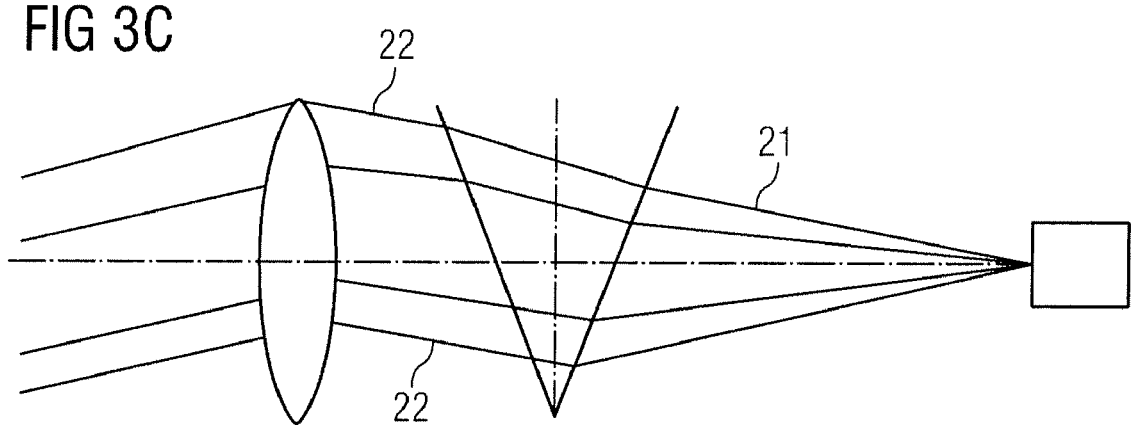

FIGS. 3A to 3C show a third exemplary embodiment of the apparatus for controlled manipulation of the beam path 21, 22 of a light-emitting diode 20. In these exemplary embodiments, the light-emitting diode is followed by a lens, for example a projection lens 50. By way of example, the light-emitting diode 20 is located in the focal plane of the lens 50 and on the optical axis 51 of the projection lens 50. In this exemplary embodiment, the apparatus for controllable manipulation of the beam path of the light-emitting diode 20 is a wedge-shaped pane 40. The wedge-shaped pane 40 contains a transparent material, for example a glass. The wedge-shaped pane 40 has an opening angle $\phi$. The wedge-shaped pane 40 can preferably be moved transversely with respect to the optical axis 51 of the projection lens 50—indicated by the double-headed arrow 53. This means that the wedge-shaped pane 40 can be moved into and out of the beam path 21 of the light-emitting diode 20.

FIG. 3B shows the wedge-shaped pane 40 moved into the beam path of the light-emitting diode 20 in such a way that a portion of the radiation 21 emitted from the light-emitting diode passes through the wedge-shaped pane 40. The radiation 21 is refracted as it passes through the wedge-shaped pane 40. In consequence, the optical position and the optical distance of the light-emitting diode 20 relative to the lens 50 are changed for that portion of the radiation which passes through the wedge-shaped pane 40.

FIG. 3C shows the wedge-shaped pane 40 arranged in the beam path 21 of the light-emitting diode 20 in such a way that the majority or all of the radiation emitted from the light-emitting diode passes through the pane 40.

The degree of refraction of the radiation 21 at the wedge-shaped pane 40 is in this case governed by the refractive index of the material being used and by the opening angle $\phi$. For example, the wedge-shaped pane 40 can be moved in the beam path of the light-emitting diode to allow continuously variable switching between different emission characteristics. For example, in this way it is possible to switch between an urban-driving light, a dipped-beam, main-beam and a motorway light, smoothly.

Figure 4:
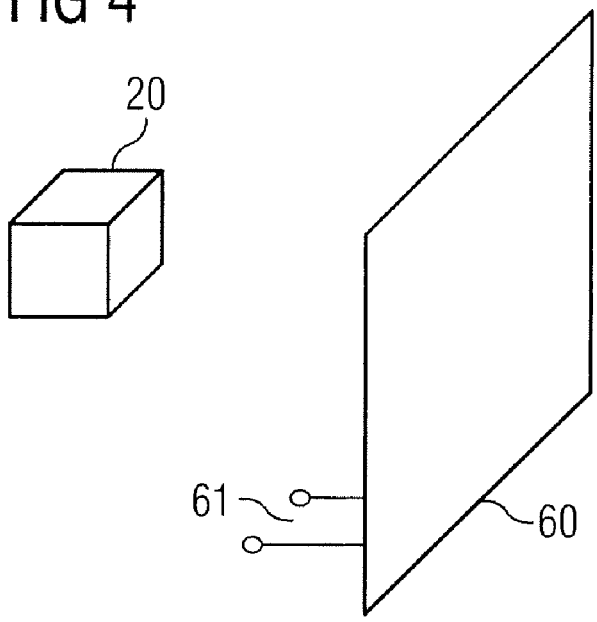
FIG. 4 shows a schematic perspective sketch of the light-emitting diode and of the apparatus for controllable manipulation of the beam path of the light-emitting diode according to a fourth exemplary embodiment.

FIG. 4 shows a fourth exemplary embodiment of the apparatus for controllable manipulation of the electromagnetic radiation emitted from the light-emitting diode 20. The apparatus is an element 60 whose optical characteristics can be varied by application of an electrical voltage 61. For example, the element 60 comprises at least one of the following elements: high-voltage membrane, switchable diffusor pane, self-darkening glass or an electrochromic material.

By way of example, the switchable diffusor pane makes it possible to switch from clear vision to a milky glass by application of an electrical voltage. This allows the radiation from the light-emitting diode to be scattered and widened, so that the area in front of the vehicle is illuminated more uniformly. For example, this makes it possible to use the motor-vehicle headlight to provide an urban-driving light, in a simple manner. The degree of scatter can be adjusted, for example, by the magnitude of the applied voltage 61.

If the element is a high-voltage membrane, then the element can be used to provide adaptive optics. This means that the high-voltage membrane changes its refractive index when an electrical voltage 61 is applied to it. This makes it possible to switch between different emission characteristics, such as an urban-driving light, a dipped-beam, a main-beam and a motorway light.

If the material is a self-darkening glass or an electrochromic material, then it is possible to adjust the intensity and the colour of the emitted light 22 by application of an electrical voltage 61.

Figure 5:
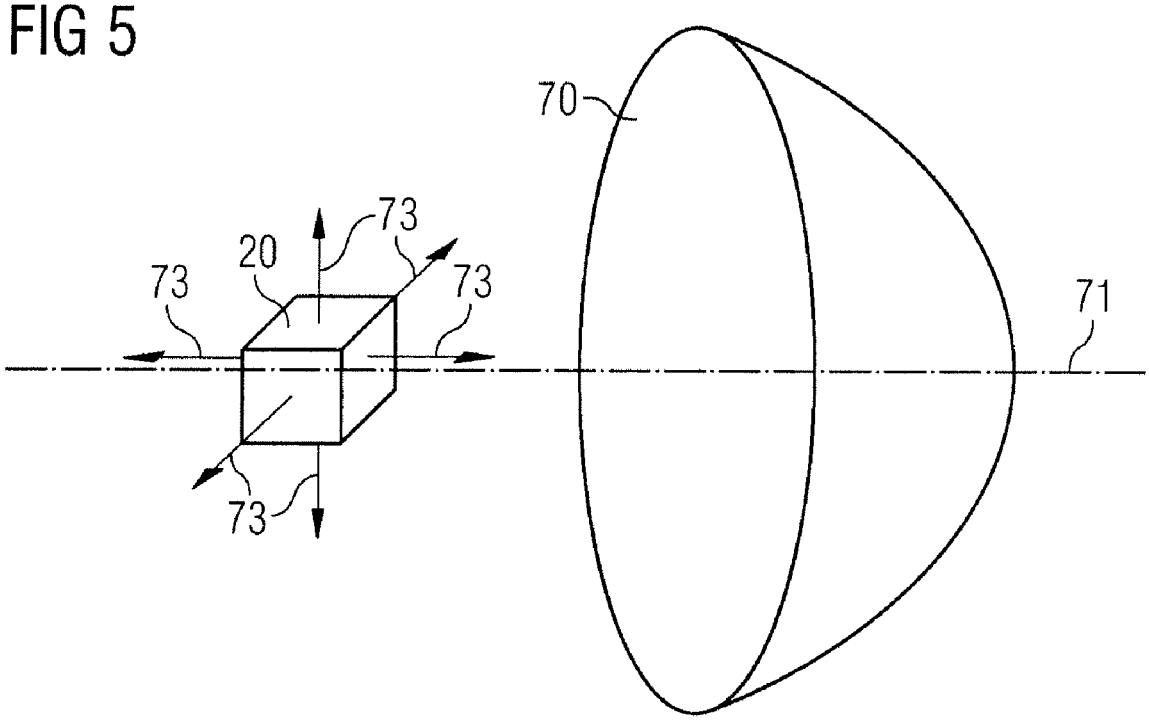
FIG. 5 shows a schematic perspective sketch of the light-emitting diode and of the apparatus for controllable manipulation of the beam path of the light-emitting diode according to a fifth exemplary embodiment.

FIG. 5 shows the arrangement of the light-emitting diode 20 relative to an optical element, for example a projection lens 70. The light-emitting diode can preferably be moved relative to the optical element. This means that the light-emitting diode can be moved along the direction indicated by the arrows 73. It is also possible to mount the light-emitting diode such that it can rotate relative to the projection lens 70. For example, the light-emitting diode 20 can be mounted such that the main emission direction of the light-emitting diode 20 does not lie on the optical axis 71 of the projection lens 70. The angle at which the radiation emitted from the light-emitting diode is projected onto the road can then be adjusted by varying the distance between the light-emitting diode 20 and the lens 70. This makes it possible to readjust the radiation from the light-emitting diode 20, for example to match the curvature of a curve, in a simple manner by changing the distance between the light-emitting diode 20 and the projection lens 70.

Figure 6A:
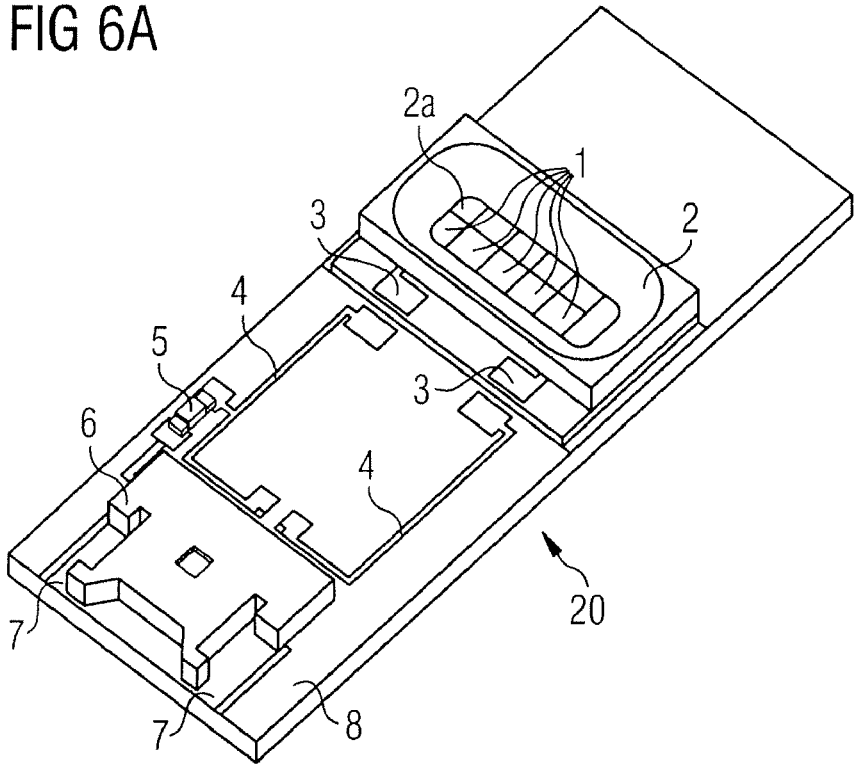
FIG. 6A shows a schematic perspective sketch of the light-emitting diode according to a first exemplary embodiment.
Figure 6B:
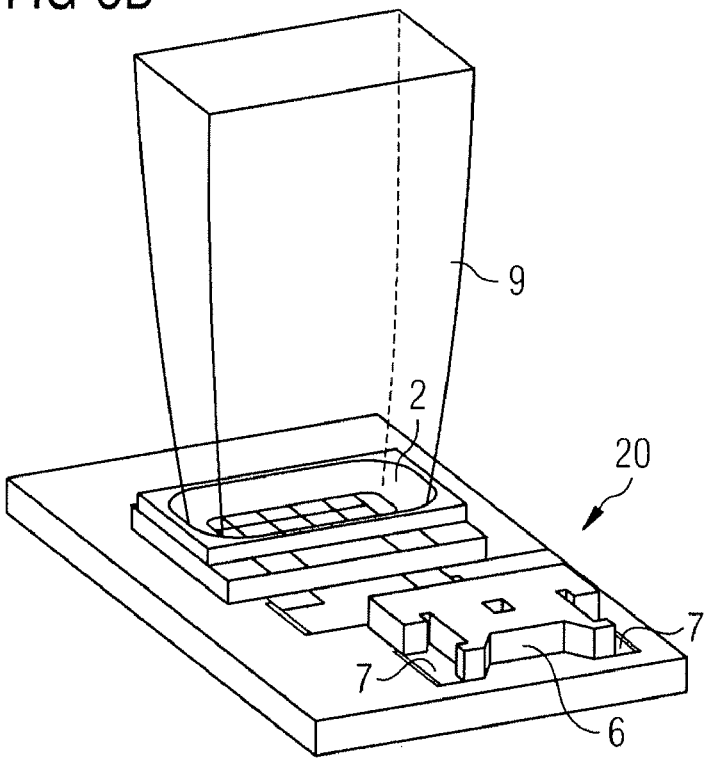
FIG. 6B shows a schematic perspective sketch of the light-emitting diode according to the first exemplary embodiment, with light-emitting diode optics.

FIG. 6A shows a schematic perspective sketch of one exemplary embodiment of the light-emitting diode 20. FIG. 6B shows the light-emitting diode 20 with light-emitting diode optics 9.

By way of example, the light-emitting diode 20 comprises five light-emitting diode chips 1. The light-emitting diode chips 1 are, for example, thin-film light-emitting diode chips 1, each having a light yield of at least 20 lm per watt.

This means that, in the case of the light-emitting diode chips 1, the growth substrate for the epitaxially grown layers of the light-emitting diode chips are either thinned or removed completely. The epitaxially grown layers are then applied with their surface facing away from the original growth substrate on a mount element.

Optoelectronic semiconductor chips of a thin-film design are described, for example, in the documents WO 02/13281 A1 or EP 0905797 A2, whose disclosure content with regard to the thin-film design of optoelectronic semiconductor chips is hereby included expressly by back-reference.

The light-emitting diode chips 1 are preferably suitable for production of light in the blue spectral band. The light-emitting diode chips 1 are then followed by a luminescence conversion material. The frequency-converted component of the radiation emitted from the light-emitting diode chips 1 is preferably mixed with the non-converted component to form white light.

The light-emitting diode chips 1 are arranged, for example, at the bottom 2*a* of a housing 2. The housing 2 may, for example, be formed from a ceramic material. The housing 2 preferably has internal walls which are designed to be reflective, at least in some places. The internal walls of the housing 2 may, for example, be shaped in the form of a non-imaging optical concentrator through which radiation passes in the opposite direction, thus resulting in collimation of the radiation emitted from the light-emitting diode chips 1. The internal walls of the housing 2 may be followed in the main emission direction of the light-emitting diode chips 1 by light-emitting diode optics 9, which may themselves be shaped in the form of a non-imaging optical concentrator.

The light-emitting diode chips 1 make contact with the contact pads 3 outside the housing 2. Conductor tracks 4 connect the contact pads 3 to connecting points 7, via which external contact can be made with the light-emitting diode 20.

For example, the connection of the light-emitting diode 20 to the motor vehicle power supply system can be made by means of a plug and a mating connector 6. At least one varistor 5 provides overvoltage protection for the light-emitting diode 20. The mating connector 6, varistor 5 and housing 2 are arranged, for example, on a metal core board 8, which acts not only as a circuit board but also as a thermally conductive element for the heat that is produced by the light-emitting diode chips 1 during operation.

In this case, it is possible for an apparatus for dimming the light-emitting diode chips 1 to be provided on the metal core board 8 or outside the light-emitting diode 20. This allows the emission characteristic of the light-emitting diode 20 to be additionally matched to external conditions, such as the weather or lighting conditions, by intensity variation. Furthermore, the intensity of the light emitted from the light-emitting diode 20 can also be varied by deliberately switching individual light-emitting diode chips 1 on and off.

One headlight may have a large number of the described light-emitting diodes 20. It is thus possible for an apparatus as shown in FIGS. 1 to 5 to have two or more associated light-emitting diodes 20. It is also possible for the light-emitting diodes 20 to be positioned in the headlight in such a way that they each illuminate a specific spatial angle area outside the motor vehicle. When turning, light-emitting diodes can then be switched on or off such that the light beam from the headlight follows the curvature of a bend, for example.

The invention is not restricted by the description based on the exemplary embodiments. In fact, the invention covers every normal feature and every combination of features, in particular including every combination of features in the patent claims, even if this feature or this combination is itself not explicitly stated in the patent claims or exemplary embodiments.

The invention claimed is:

1. A motor-vehicle headlight, comprising:

at least one light-emitting diode, and an apparatus for controllable manipulation of the beam path of the electromagnetic radiation emitted from the light-emitting diode~ the apparatus for controllable manipulation of the beam path comprising a deflection mirror shaped as an n-edged pane, n being an integer greater than two, and the deflection mirror having at least two mirror surfaces, each mirror surface arranged at an edge of the pane, wherein the deflection mirror pivots about a longitudinal axis of the pane such that different mirror surfaces are illuminated by the electromagnetic radiation as the deflection mirror pivots about the longitudinal axis, wherein each mirror surface has a different optical characteristic that is assigned to a light function, the deflection mirror is rotatable about an angle such that light of the at least one light-emitting diode illuminates a first or second of the at least two mirror surfaces, and the assigned light functions of the mirror surfaces are chosen from at least two different of the following light functions such that the motor-vehicle headlight emits light with an emission characteristic assigned to the chosen light function: urban driving light; dipped-beam; main-beam; and motorway light, wherein the at least one light-emitting diode is a light source of the motor-vehicle headlight.

2. The motor-vehicle headlight-according to claim 1, wherein the apparatus comprises a wedge-shaped pane.

3. The motor-vehicle headlight according to claim 2, wherein the wedge-shaped pane is movable in the beam path of the light-emitting diode.

4. The motor-vehicle headlight according to claim 1, 2, or 3, wherein the apparatus comprises an element, the optical characteristics of the element are adjustable by application of an electrical voltage.

5. The motor-vehicle headlight according to claim 4, in which the element is made of an electrochromic material.

6. The motor-vehicle headlight according to claim 4, in which the element is made of self-darkening glass.

7. The motor-vehicle headlight according to claim 4, in which the element comprises a switchable diffuser pane.

8. The motor-vehicle headlight according to claim 7, in which the degree of scatter of electromagnetic radiation by the diffuser pane is dependent on the electrical voltage applied to the diffuser pane.

9. The motor-vehicle headlight according to claim 4, in which the refractive index of the element is dependent on the voltage.

10. The motor-vehicle headlight according to claim 1, further comprising at least two light-emitting diodes, which are arranged to illuminate different spatial angle areas.

11. The motor-vehicle headlight according to claim 10, further comprising having a switching apparatus which switches light-emitting diodes as a function of the direction of travel of the motor vehicle.

12. The motor-vehicle headlight according to claim 1, wherein the optical characteristic of each of the at least two mirror surfaces determines the emission characteristic of the radiation which is reflected by each of the at least two mirror surfaces.

13. The motor-vehicle headlight according to claim 12 wherein the emission characteristic of the radiation which is reflected is one of the following characteristics:

shape, intensity distribution, colour, direction, beam angle.

14. The motor-vehicle headlight according to claim 1, wherein one of the at least two mirror surfaces comprises a sandpaper mirror which has a roughened reflective surface.

15. The motor-vehicle headlight according to claim 1, wherein the deflection mirror is pivoted on an axis which runs transversely with respect to the longitudinal axis.

16. The motor-vehicle headlight according to claim 1, wherein the at least one light-emitting diode emits white light.

* * * * *

UNITED STATES PATENT AND TRADEMARK OFFICE

CERTIFICATE OF CORRECTION

PATENT NO. : 8,096,689 B2
APPLICATION NO. : 11/924209
DATED : January 17, 2012
INVENTOR(S) : Moritz Engl et al.

It is certified that error appears in the above-identified patent and that said Letters Patent is hereby corrected as shown below:

In Claim 1, column 11, line 19, delete “diode~” and insert -- diode, --.

In Claim 2, column 11, line 42, delete “headlight-according” and insert -- headlight according --.

In Claim 4, column 12, line 1, delete “claim” and insert -- claims --.

Signed and Sealed this
Third Day of April, 2012

David J. Kappos

David J. Kappos
*Director of the United States Patent and Trademark Office*